US011634994B2

(12) United States Patent
MacDougall et al.

(10) Patent No.: US 11,634,994 B2
(45) Date of Patent: Apr. 25, 2023

(54) NOZZLE GUIDE VANE

(71) Applicant: ROLLS-ROYCE plc, London (GB)

(72) Inventors: Duncan A MacDougall, Derby (GB); Jaime Terron Fraile, Derby (GB)

(73) Assignee: ROLLS-ROYCE plc, London (GB)

( * ) Notice: Subject to any disclaimer, the term of this patent is extended or adjusted under 35 U.S.C. 154(b) by 0 days.

(21) Appl. No.: 17/663,600

(22) Filed: May 16, 2022

(65) Prior Publication Data

US 2022/0372886 A1 Nov. 24, 2022

(30) Foreign Application Priority Data

May 19, 2021 (GB) ..... 2107128

(51) Int. Cl.

| | |
|---|---|
| ***F01D 9/04*** | (2006.01) |
| ***F01D 5/14*** | (2006.01) |
| ***F01D 5/18*** | (2006.01) |
| ***F01D 21/04*** | (2006.01) |

(52) U.S. Cl.

CPC ..... *F01D 9/041* (2013.01); *F01D 5/141* (2013.01); *F01D 5/147* (2013.01); *F01D 5/18* (2013.01); *F01D 21/045* (2013.01); *F05D 2240/121* (2013.01); *F05D 2240/122* (2013.01); *F05D 2240/123* (2013.01); *F05D 2240/124* (2013.01); *F05D 2240/128* (2013.01)

(58) Field of Classification Search

CPC ..... F01D 9/041; F01D 5/141; F01D 5/147; F01D 5/18; F01D 21/045; F05D 2240/121; F05D 2240/122; F05D 2240/123; F05D 2240/124; F05D 2240/128

See application file for complete search history.

(56) References Cited

U.S. PATENT DOCUMENTS

| | | | | |
|---|---|---|---|---|
| 10,125,620 | B2 * | 11/2018 | Alvanos | C04B 35/71 |
| 2005/0042083 | A1 * | 2/2005 | MilBurn | F01D 9/041 415/208.1 |
| 2005/0106011 | A1 * | 5/2005 | Tiemann | F01D 5/147 415/191 |
| 2005/0260076 | A1 | 11/2005 | Daux et al. | |
| 2007/0148003 | A1 * | 6/2007 | Trishkin | F01D 5/288 416/241 R |
| 2009/0148280 | A1 * | 6/2009 | Schilp | F01D 5/141 415/177 |
| 2016/0061042 | A1 * | 3/2016 | Duong | F01D 5/145 416/223 R |

(Continued)

FOREIGN PATENT DOCUMENTS

| | | |
|---|---|---|
| EP | 0185599 A1 | 6/1986 |
| EP | 0185599 B1 | 6/1986 |

(Continued)

OTHER PUBLICATIONS

Oct. 26, 2022 Extended European Search Report issued in European Patent Application No. 22168930.0.

*Primary Examiner* — Juan G Flores
*Assistant Examiner* — Brian Christopher Delrue
(74) *Attorney, Agent, or Firm* — Oliff PLC

(57) ABSTRACT

A nozzle guide vane for a gas turbine engine having a combined side wall thickness value which varies within a cavity region so as to provide a point with a maximum value of combined side wall thickness, which is advantageous for capturing debris travelling through the engine core.

17 Claims, 15 Drawing Sheets

(56) References Cited

U.S. PATENT DOCUMENTS

| | | | | |
|---|---|---|---|---|
| 2016/0090846 | A1* | 3/2016 | Riley | F01D 5/189<br>415/115 |
| 2017/0175530 | A1* | 6/2017 | Soni | F01D 5/141 |
| 2017/0175628 | A1 | 6/2017 | Subramanian et al. | |
| 2017/0350255 | A1* | 12/2017 | Couture | F01D 5/18 |
| 2019/0345833 | A1* | 11/2019 | Thornton | F01D 25/12 |
| 2019/0383148 | A1* | 12/2019 | Ertl | F01D 5/187 |
| 2022/0220855 | A1* | 7/2022 | Hayek | F01D 25/12 |

FOREIGN PATENT DOCUMENTS

| | | | |
|---|---|---|---|
| EP | 1 598 523 | A1 | 11/2005 |
| EP | 3 467 266 | A1 | 4/2019 |
| EP | 3511523 | A1 | 7/2019 |
| EP | 3511523 | B1 | 7/2019 |
| WO | 2015/034815 | A1 | 3/2015 |

* cited by examiner

NOZZLE GUIDE VANE

CROSS-REFERENCE TO RELATED APPLICATIONS

This application claims priority pursuant to 35 U.S.C. 119(a) to United Kingdom Patent Application No. 2107128.7, filed May 19, 2021, which application is incorporated herein by reference in its entirety.

BACKGROUND

Field of the Disclosure

The present disclosure relates to a design of nozzle guide vane for a gas turbine engine. The design features of the nozzle guide vane disclosed are particularly advantageous in that they provide an improved means for capturing released turbine blades.

Aircraft engines are designed to withstand the rigours of operation across all manner of working environments. However, rare events occur when an element of an engine breaks or is broken away from its original location. In such cases, the engine is designed to contain as much of the resulting debris as possible. It is also beneficial to arrest the movement of the debris as quickly as possible, as the further into the engine the debris travels, the more damage it can do. For example, if a turbine blade or piece of a turbine blade is released into the engine, the further it travels through the engine core, the greater the number of other components the debris might damage.

SUMMARY OF THE DISCLOSURE

According to a first aspect there is provided a nozzle guide vane for a gas turbine engine, the nozzle guide vane comprising a pressure side wall having a first pressure surface on the exterior of the nozzle guide vane and a second pressure surface on the interior of the nozzle guide vane; a suction side wall having a first suction surface on the exterior of the nozzle guide vane and a second suction surface on the interior of the nozzle guide vane; a radially inner boundary; a radially outer boundary; a leading edge; and a trailing edge; wherein the pressure side wall and suction side wall extend from the radially inner boundary to the radially outer boundary and from the leading edge to the trailing edge; the nozzle guide vane further comprising a cavity region where the second pressure surface and the second suction surface are spaced apart so as to create a cavity between them, the cavity having a cavity opening point which is nearest to the leading edge of the nozzle guide vane, and a cavity closing point which is nearest to the trailing edge of the nozzle guide vane; wherein the nozzle guide vane has a chord line which is a straight line connecting the leading edge to the trailing edge; wherein, in each plane of constant radial extent between the radially inner boundary and radially outer boundary, a pressure side wall thickness value for any point on the chord line is defined as the distance between the first pressure surface and the second pressure surface measured perpendicular to the chord line at that point on the chord line; and a suction side wall thickness value for any point on the chord line is defined as the distance between the first suction surface and the second suction surface measured perpendicular to the chord line at that point on the chord line; wherein the sum of the pressure side wall thickness value and the suction side wall thickness value for a given point of the chord line between the cavity opening point and the cavity closing point is defined as the combined side wall thickness; and wherein the combined side wall thickness varies along the chord line between the cavity opening point and the cavity closing point, such that the maximum value of the combined side wall thickness is at a point on the chord line between 30% and 70% of the chord line. The nozzle guide vane of claim 1 is advantageous in that the greater combined thickness of the pressure side wall and suction side wall in the central cavity region allows the nozzle guide vane to absorb a greater amount of energy from any debris impacting upon it, increasing its ability to arrest the movement of, for example, debris from a broken turbine blade. It also decreases the chances of the debris breaking up into smaller pieces which might travel further into the engine.

According to some embodiments, the maximum value of the combined side wall thickness value is at a point on the chord line between 40% and 60% of the chord line, or between 47% and 53% of the chord line.

According to some embodiments, the leading edge region of the nozzle guide vane may extend up to 10% of the length of the chord line from the leading edge. In other embodiments, the leading edge region may extend up to 6% of the length of the chord line from the leading edge. Nozzle guide vanes with leading edge regions of such length have been found to have optimised debris-catching performance.

According to some embodiments, the trailing edge region may extend from up to 10% to up to 30% of the length of the chord line from the trailing edge. In other embodiments, embodiments of the present disclosure, the trailing edge region may extend from up to 18% to up to 22% of the length of the chord line from the trailing edge. Nozzle guide vanes with trailing edge regions of such length have been found to have optimised debris-catching performance.

According to some embodiments, the minimum value of the combined side wall thickness at a point on the chord line between the cavity opening point and the cavity closing point equals a minimum combined side wall thickness, and the maximum value of the combined side wall thickness at a point on the chord line between the cavity opening point and the cavity closing point equals a maximum combined side wall thickness, and the ratio between the maximum combined side wall thickness and the minimum combined side wall thickness is between 1.6:1 and 3:1. According to some embodiments, the ratio between the maximum cavity region thickness and the maximum cavity opening region thickness is between 2:1 and 2.5:1.

According to some embodiments, only one of the pressure side wall or the suction side wall varies in thickness within the cavity region. Providing a region of increased thickness on just one of the pressure or suction side walls can still improve the nozzle guide vane's ability to absorb energy from and capture incoming debris, and reduces the amount of additional mass added to the nozzle guide vane.

According to some embodiments, the maximum value of the combined side wall thickness varies between planes of constant radial extent. Such configurations can allow the nozzle guide vane to be optimised based on where along its radial extent debris is most likely to strike.

According to some embodiments, the maximum value of the combined side wall thickness has a minimum value at the plane of minimum radial extent of the nozzle guide vane and a maximum value at the plane of maximum radial extent of the nozzle guide vane. Such a configuration is optimised for when it is determined debris is most likely to strike towards the outermost radial extent of the nozzle guide vane.

According to some embodiments, the maximum value of the combined side wall thickness increases from the plane of minimum radial extent of the nozzle guide vane and reaches a maximum value at a plane between 40% and 60% of the maximum radial extent of the nozzle guide vane.

Also disclosed is a gas turbine engine comprising one or more nozzle guide vanes according to the embodiments disclosed herein. Such a gas turbine engine may comprise an engine core comprising a turbine, a combustor, a compressor, and a core shaft connecting the turbine to the compressor. Such a gas turbine engine may comprise a fan (having fan blades) located upstream of the engine core.

Arrangements of the present disclosure may be particularly, although not exclusively, beneficial for fans that are driven via a gearbox. Accordingly, the gas turbine engine may comprise a gearbox that receives an input from the core shaft and outputs drive to the fan so as to drive the fan at a lower rotational speed than the core shaft. The input to the gearbox may be directly from the core shaft, or indirectly from the core shaft, for example via a spur shaft and/or gear. The core shaft may rigidly connect the turbine and the compressor, such that the turbine and compressor rotate at the same speed (with the fan rotating at a lower speed).

The gas turbine engine as described and/or claimed herein may have any suitable general architecture. For example, the gas turbine engine may have any desired number of shafts that connect turbines and compressors, for example one, two or three shafts. Purely by way of example, the turbine connected to the core shaft may be a first turbine, the compressor connected to the core shaft may be a first compressor, and the core shaft may be a first core shaft. The engine core may further comprise a second turbine, a second compressor, and a second core shaft connecting the second turbine to the second compressor. The second turbine, second compressor, and second core shaft may be arranged to rotate at a higher rotational speed than the first core shaft.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

BRIEF DESCRIPTION OF THE DRAWINGS

Embodiments will now be described by way of example only, with reference to the Figures, in which.

DETAILED DESCRIPTION OF THE DISCLOSURE

Aspects and embodiments of the present disclosure will now be discussed with reference to the accompanying figures. Further aspects and embodiments will be apparent to those skilled in the art.

Figure 1:
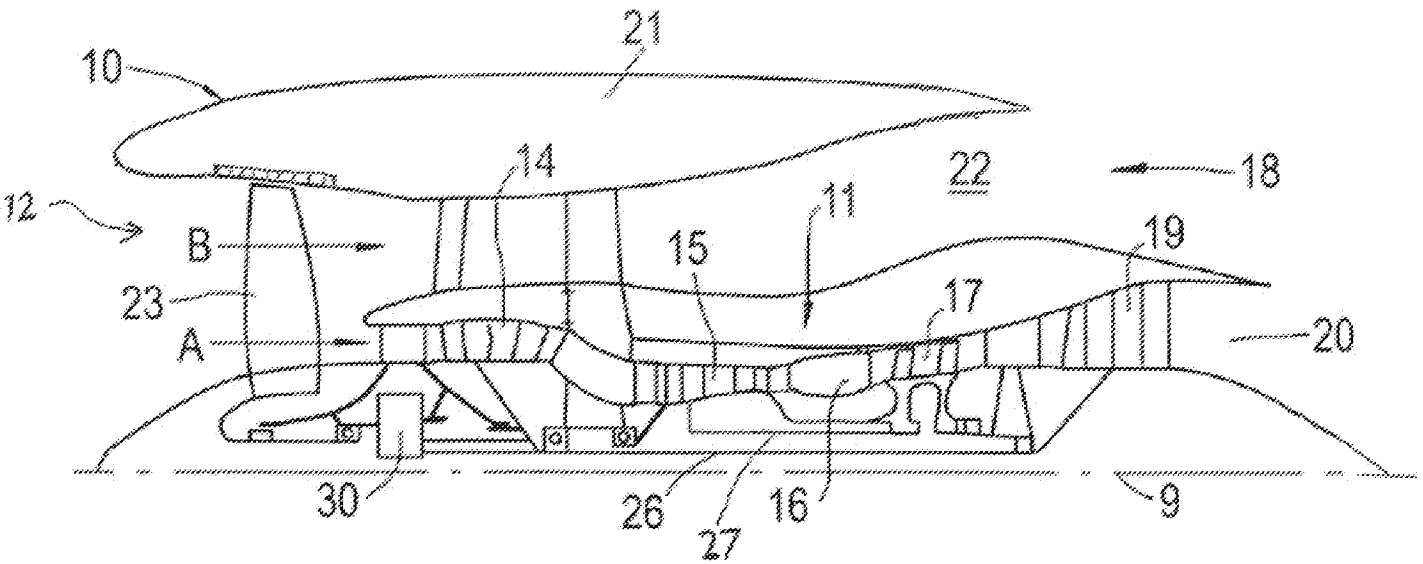
FIG. 1 is a sectional side view of a gas turbine engine.

FIG. 1 illustrates a gas turbine engine 10 having a principal rotational axis 9. The engine 10 comprises an air intake 12 and a propulsive fan 23 that generates two airflows: a core airflow A and a bypass airflow B. The gas turbine engine 10 comprises an engine core 11 that receives the core airflow A. The engine core 11 comprises, in axial flow series, a low pressure compressor 14, a high-pressure compressor 15, combustion equipment 16, a high-pressure turbine 17, a low pressure turbine 19 and a core exhaust nozzle 20. A nacelle 21 surrounds the gas turbine engine 10 and defines a bypass duct 22 and a bypass exhaust nozzle 18. The bypass airflow B flows through the bypass duct 22. The fan 23 is attached to and driven by the low pressure turbine 19 via a shaft 26 and an epicyclic gearbox 30.

In use, the core airflow A is accelerated and compressed by the low pressure compressor 14 and directed into the high pressure compressor 15 where further compression takes place. The compressed air exhausted from the high pressure compressor 15 is directed into the combustion equipment 16 where it is mixed with fuel and the mixture is combusted. The resultant hot combustion products then expand through, and thereby drive, the high pressure and low pressure turbines 17, 19 before being exhausted through the nozzle 20 to provide some propulsive thrust. The high pressure turbine 17 drives the high pressure compressor 15 by a suitable interconnecting shaft 27. The fan 23 generally provides the majority of the propulsive thrust. The epicyclic gearbox 30 is a reduction gearbox.

Figure 2:
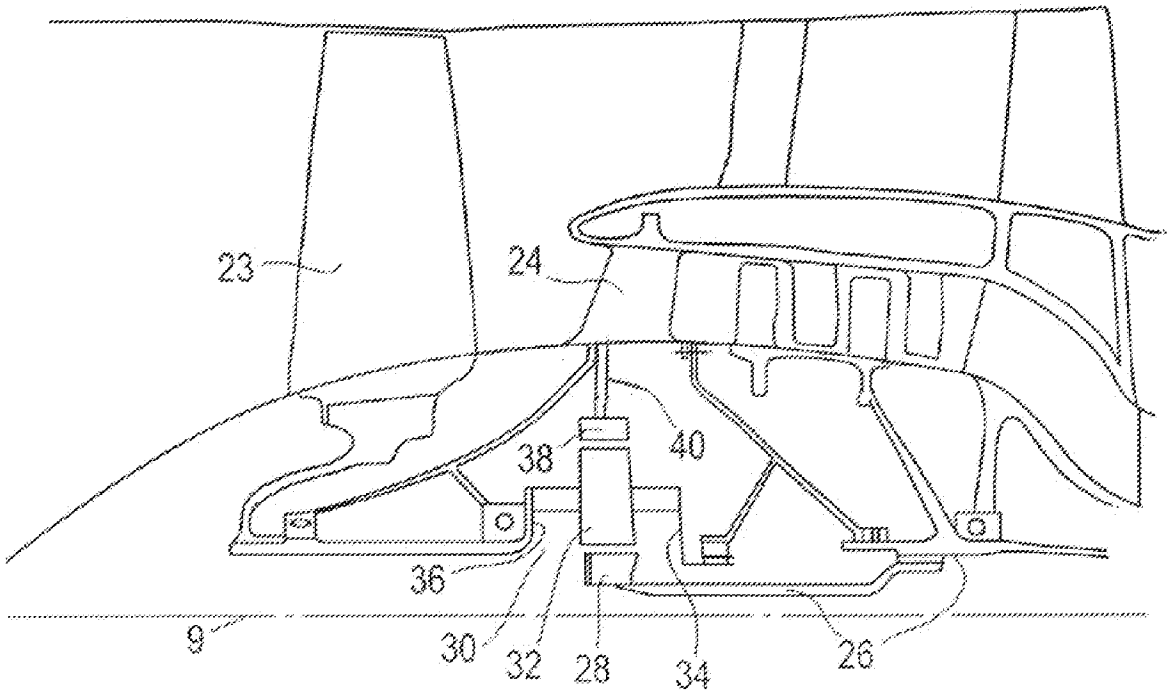
FIG. 2 is a close up sectional side view of an upstream portion of a gas turbine engine.

An exemplary arrangement for a geared fan gas turbine engine 10 is shown in FIG. 2. The low pressure turbine 19 (see FIG. 1) drives the shaft 26, which is coupled to a sun wheel, or sun gear, 28 of the epicyclic gear arrangement 30. Radially outwardly of the sun gear 28 and intermeshing therewith is a plurality of planet gears 32 that are coupled together by a planet carrier 34. The planet carrier 34 constrains the planet gears 32 to precess around the sun gear 28 in synchronicity whilst enabling each planet gear 32 to rotate about its own axis. The planet carrier 34 is coupled via linkages 36 to the fan 23 in order to drive its rotation about the engine axis 9. Radially outwardly of the planet gears 32 and intermeshing therewith is an annulus or ring gear 38 that is coupled, via linkages 40, to a stationary supporting structure 24.

Note that the terms "low pressure turbine" and "low pressure compressor" as used herein may be taken to mean the lowest pressure turbine stages and lowest pressure compressor stages (i.e. not including the fan 23) respectively and/or the turbine and compressor stages that are connected together by the interconnecting shaft 26 with the lowest rotational speed in the engine (i.e. not including the gearbox output shaft that drives the fan 23). In some literature, the "low pressure turbine" and "low pressure compressor" referred to herein may alternatively be known as the "intermediate pressure turbine" and "intermediate pressure compressor". Where such alternative nomenclature is used, the fan 23 may be referred to as a first, or lowest pressure, compression stage.

Figure 3:
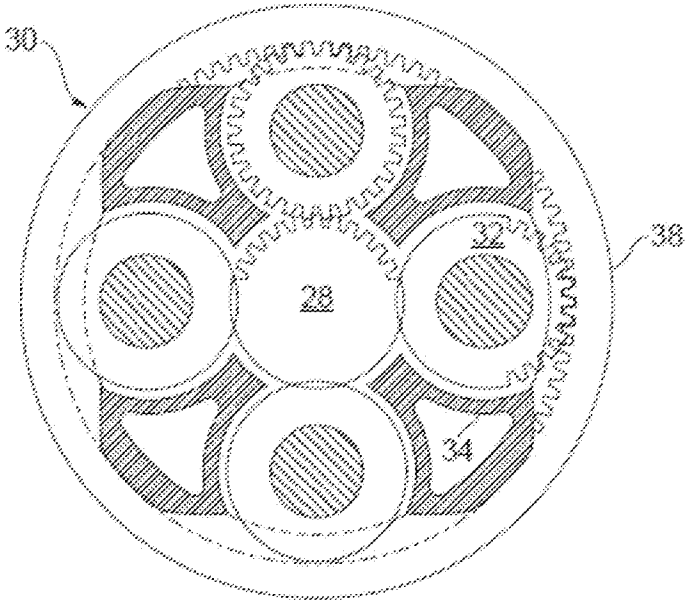
FIG. 3 is a partially cut-away view of a gearbox for a gas turbine engine.

The epicyclic gearbox 30 is shown by way of example in greater detail in FIG. 3. Each of the sun gear 28, planet gears 32 and ring gear 38 comprise teeth about their periphery to intermesh with the other gears. However, for clarity only exemplary portions of the teeth are illustrated in FIG. 3. There are four planet gears 32 illustrated, although it will be apparent to the skilled reader that more or fewer planet gears 32 may be provided within the scope of the claimed invention. Practical applications of a planetary epicyclic gearbox 30 generally comprise at least three planet gears 32.

The epicyclic gearbox 30 illustrated by way of example in FIGS. 2 and 3 is of the planetary type, in that the planet carrier 34 is coupled to an output shaft via linkages 36, with the ring gear 38 fixed. However, any other suitable type of epicyclic gearbox 30 may be used. By way of further example, the epicyclic gearbox 30 may be a star arrangement, in which the planet carrier 34 is held fixed, with the ring (or annulus) gear 38 allowed to rotate. In such an arrangement the fan 23 is driven by the ring gear 38. By way of further alternative example, the gearbox 30 may be a differential gearbox in which the ring gear 38 and the planet carrier 34 are both allowed to rotate.

It will be appreciated that the arrangement shown in FIGS. 2 and 3 is by way of example only, and various alternatives are within the scope of the present disclosure. Purely by way of example, any suitable arrangement may be used for locating the gearbox 30 in the engine 10 and/or for connecting the gearbox 30 to the engine 10. By way of further example, the connections (such as the linkages 36, 40 in the FIG. 2 example) between the gearbox 30 and other parts of the engine 10 (such as the input shaft 26, the output shaft and the fixed structure 24) may have any desired degree of stiffness or flexibility. By way of further example, any suitable arrangement of the bearings between rotating and stationary parts of the engine (for example between the input and output shafts from the gearbox and the fixed structures, such as the gearbox casing) may be used, and the disclosure is not limited to the exemplary arrangement of FIG. 2. For example, where the gearbox 30 has a star arrangement (described above), the skilled person would readily understand that the arrangement of output and support linkages and bearing locations would typically be different to that shown by way of example in FIG. 2.

Accordingly, the present disclosure extends to a gas turbine engine having any arrangement of gearbox styles (for example star or planetary), support structures, input and output shaft arrangement, and bearing locations.

Optionally, the gearbox may drive additional and/or alternative components (e.g. the intermediate pressure compressor and/or a booster compressor).

Other gas turbine engines to which the present disclosure may be applied may have alternative configurations. For example, such engines may have an alternative number of compressors and/or turbines and/or an alternative number of interconnecting shafts. By way of further example, the gas turbine engine shown in FIG. 1 has a split flow nozzle 18, 20 meaning that the flow through the bypass duct 22 has its own nozzle 18 that is separate to and radially outside the core exhaust nozzle 20. However, this is not limiting, and any aspect of the present disclosure may also apply to engines in which the flow through the bypass duct 22 and the flow through the engine core 11 are mixed, or combined, before (or upstream of) a single nozzle, which may be referred to as a mixed flow nozzle. One or both nozzles (whether mixed or split flow) may have a fixed or variable area. Whilst the described example relates to a turbofan engine, the disclosure may apply, for example, to any type of gas turbine engine, such as an open rotor (in which the fan stage is not surrounded by a nacelle) or turboprop engine, for example. In some arrangements, the gas turbine engine 10 may not comprise a gearbox 30.

The geometry of the gas turbine engine 10, and components thereof, is defined by a conventional axis system, comprising an axial direction (which is aligned with the rotational axis 9), a radial direction (in the bottom-to-top direction in FIG. 1), and a circumferential direction (perpendicular to the page in the FIG. 1 view). The axial, radial and circumferential directions are mutually perpendicular.

Figure 4:
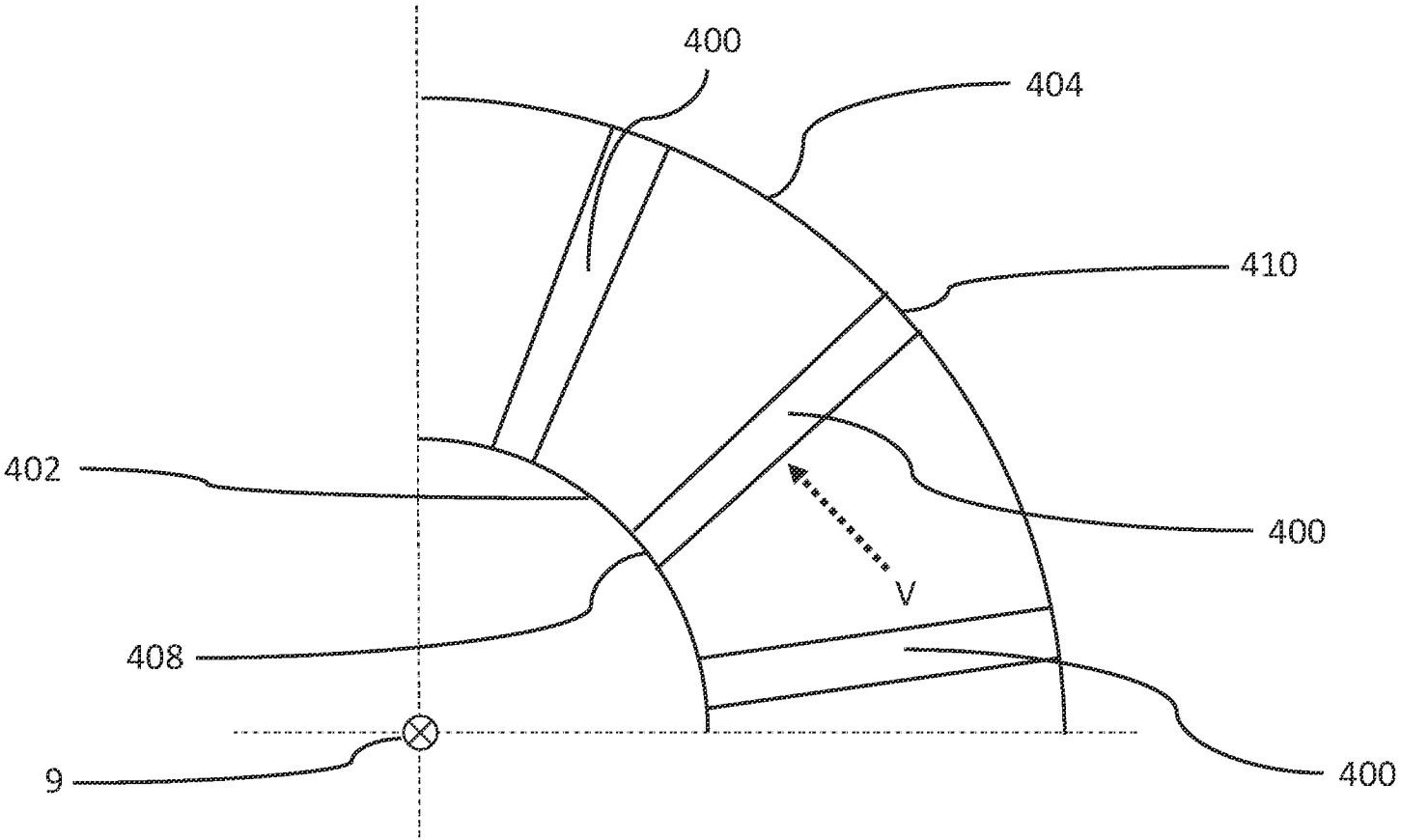
FIG. 4 is a sectional axial view of a subregion of a gas turbine engine core.

FIG. 4 shows a sectional axial view of a subregion of a gas turbine engine core. Core airflow A flows through the engine core between the inner wall 402 and outer wall 404 of the engine core flowpath. The view of FIG. 4 is in the direction of the core airflow A into the plane of the page. For clarity FIG. 4 only shows a quarter of the engine core flowpath, but it can form a full circle around the engine principle axis 9. Extending between the inner wall 402 and outer wall 404 of the engine core flowpath are a number of nozzle guide vanes 400. The number of and spacing between the nozzle guide vanes 400 can vary depending on design requirements. Only three are shown here for clarity. Each nozzle guide vane has a radially inner boundary 408 which contacts the inner wall 402 of the engine core flowpath and a radially outer boundary 410 which contacts the outer wall 404 of the engine core flowpath. In this way the nozzle guide vanes extend completely across the engine core flowpath so as to condition the core airflow A as it passes between them. Dashed arrow V in FIG. 4 indicates the viewpoint of the image shown in FIG. 5.

Figure 5:
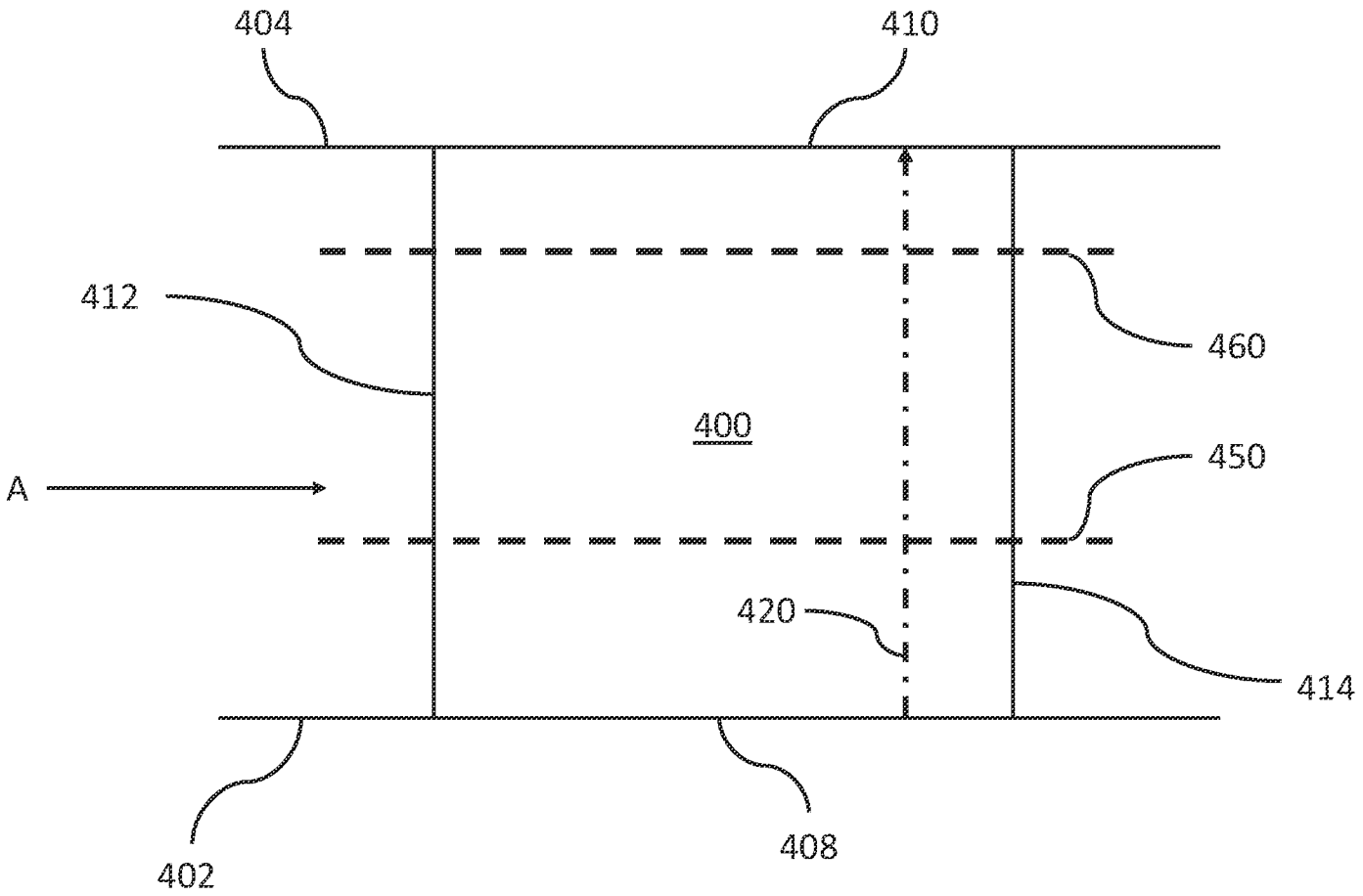
FIG. 5 is a side view of a nozzle guide vane within the gas turbine engine core.

FIG. 5 is a side-on view of a nozzle guide vane 400. The nozzle guide vane 400 extends radially from its radially inner boundary 408 in contact with the inner wall 402 of the engine core flowpath to its radially outer boundary 410 in contact with the outer wall 404 of the engine core flowpath. The direction of the core airflow across the nozzle guide vane 400 is indicated by arrow A. The nozzle guide vane 400 has a leading edge 412 positioned at the most upstream point of the nozzle guide vane, i.e. the part of the nozzle guide vane that core airflow A impacts upon first, and a trailing edge 414 positioned at the most downstream part of the nozzle guide vane, i.e. the part of the nozzle guide vane that core airflow A impacts upon last. FIG. 5 also shows the direction of increasing radial extent 420, extending from the radially inner boundary 408 which is at 0% of the radial extent to the radially outer boundary 410 which is at 100% of the radial extent. Exemplary planes of constant radial extent 450, 460 i.e. planes which cut through the nozzle guide vane at a constant radial extent from the engine axis, are shown. In this example, the first plane of constant radial extent 450 is at approximately 30% of the radial extent of the nozzle guide vane 400, and the second plane of constant radial extent 460 is at approximately 80% of the radial extent of the nozzle guide vane 400.

Figure 6:
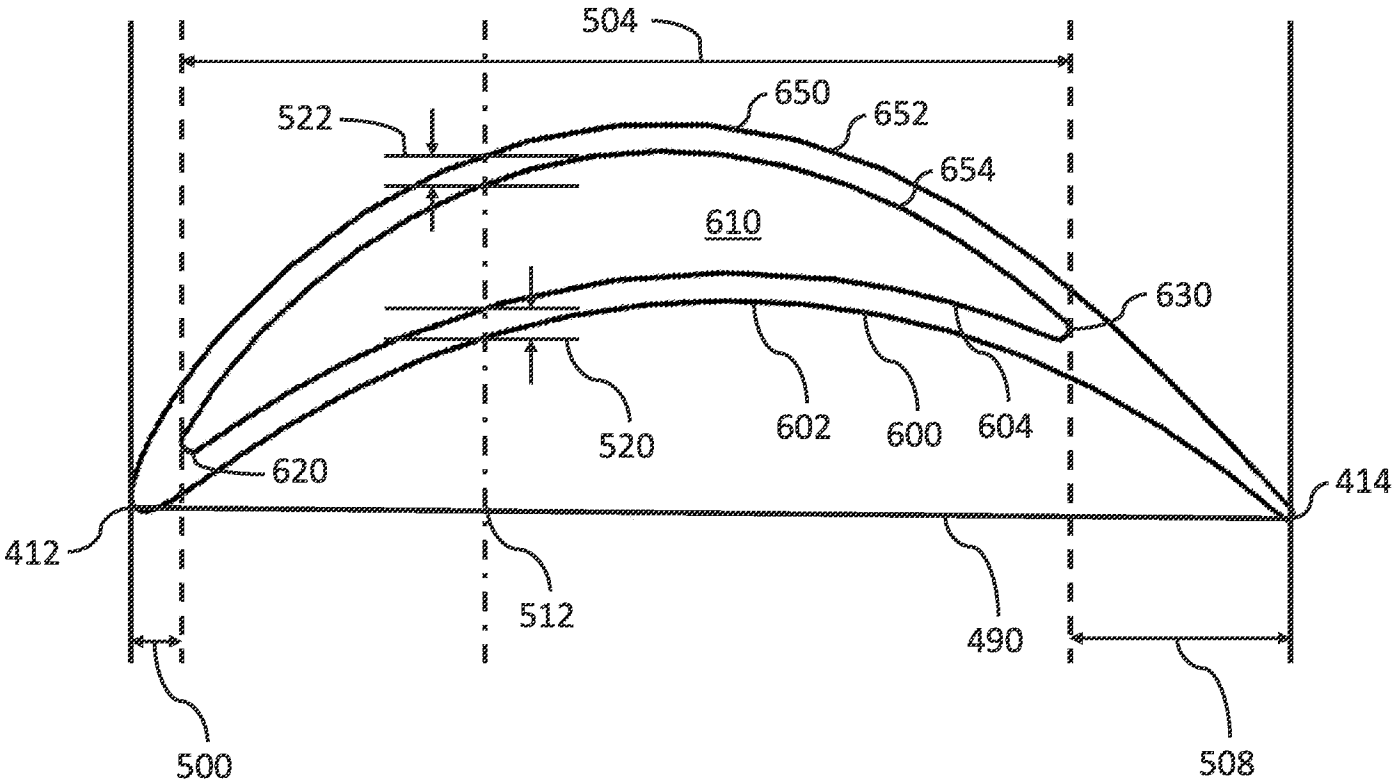
RELATED ART FIG. 6
FIG. 6 is a sectional view through a known nozzle guide vane.

FIG. 6 shows a first sectional view through a plane of constant radial extent of a known nozzle guide vane 400. As shown in FIG. 6, the nozzle guide vane 400 has an aerofoil shape, although the external shape of the nozzle guide vane can vary depending on design requirements and constraints. The external shape can also vary radially between the inner wall 402 and outer wall 404. The nozzle guide vane has a chord line 490 which runs in a straight line from the leading edge 412 to the trailing edge 414. The sectional characteristics (i.e. the topographical characteristics shown in this sectional view) of the nozzle guide vane are constant along its entire radial extent. The leading edge 412 and trailing edge 414 can be seen at the most upstream and downstream points of the nozzle guide vane 400 as described in relation to FIG. 5. The nozzle guide vane has a pressure side wall 600 and a suction side wall 650, "pressure" and "suction" referring to the forces experienced on the nozzle guide vane as air passes around it. The pressure side wall 600 comprises a first pressure surface 602 on the exterior of the nozzle guide vane and a second pressure surface 604 on the interior of the nozzle guide vane. The suction side wall 650 comprises a first suction surface 652 on the exterior of the nozzle guide vane and a second suction surface 654 on the interior of the nozzle guide vane. The pressure side wall 600 and suction side wall 650 extend from the leading edge 412 to the trailing edge 414 of the nozzle guide vane along its axial dimension, and from its radially inner boundary 408 to its radially outer boundary 410 in its radial axis (see FIGS. 4 and 5). The thickness of the pressure side wall 600 at any point along the chord line 490 is equal to the distance in a plane of constant radial extent between the first pressure surface 602 and the second pressure surface 604 measured perpendicular to that point on the chord line 490. An example 520 of a pressure side wall thickness measurement is shown in FIG. 6, where the distance between the first pressure surface 602 and the second pressure surface 604 measured at a point 512 on the chord line 490. The thickness of the suction side wall 650 at any point along the chord line 490 is equal to the distance in a plane of constant radial extent between the first suction surface 652 and the second suction surface 654 measured perpendicular to that point on the chord line 490. An example 522 of a suction side wall thickness measurement, in this case taken at the same point 512 along the chord line as the example pressure side measurement, is also shown in FIG. 6. The sum of the pressure side wall thickness 520 and suction side wall thickness 522 at the same point along the chord line, such as that shown in FIG. 6, is defined as the combined side wall thickness.

The nozzle guide vane 400 is hollow, and as such there is a cavity 610 between sections of the pressure side wall 600 and suction side wall 650. The most upstream part of the cavity 610 is the cavity opening point 620 which is nearest to the leading edge 412 of the nozzle guide vane, and the most downstream part of the cavity 610 is the cavity closing point 630 which is closest to the trailing edge 414 of the nozzle guide vane.

The nozzle guide vane has been divided into three regions along its length as defined by the chord line 490: a leading edge region 500, a cavity region 504, and a trailing edge region 508. The regions are determined by the nature of the pressure 600 and suction 650 side walls. The leading edge region 500 extends between the leading edge 412 of the nozzle guide vane and the cavity opening point 620. The pressure side wall 600 and the suction side wall 650 are joined throughout the leading edge region 500. The cavity region 504 extends between the cavity opening point 620 and the cavity closing point 630. The pressure side wall 600 and the suction side wall 650 are separated by the cavity 610 throughout the cavity region 504. Finally the trailing edge region extends from the cavity closing point 630 to the trailing edge 414. The pressure side wall 600 and the suction side wall 650 are joined throughout the trailing edge region 508.

The features and parameters described in relation to the known nozzle guide vane of FIG. 6 are used to describe corresponding features and parameters in the exemplary embodiments disclosed in relation to FIGS. 7 to 15. The main point to be noted with regards to the known nozzle guide vane as shown in FIG. 6 is that the thicknesses of the pressure side wall 600 and suction side wall 650 stay constant throughout the cavity region 504.

None of the nozzle guide vanes described herein comprises cross-beams, supports or internal web structures. It is known to sometimes use cross-beams or internal web structures to provide increased structural integrity in hollow structures, including nozzle guide vanes. It will be understood that the present disclosure does not preclude the use of such cross-beams, supports or internal web structures in addition to the features described herein. However, for the purpose of this disclosure, such internal features represent discontinuities of the second pressure surface 604 and second suction surface 654, and do not contribute towards the features of the disclosure. The embodiments described herein are characterized by regions of the second pressure surface 604 and second suction surface 654 other than those which include such cross-beams, supports or internal web structures.

Figure 7:
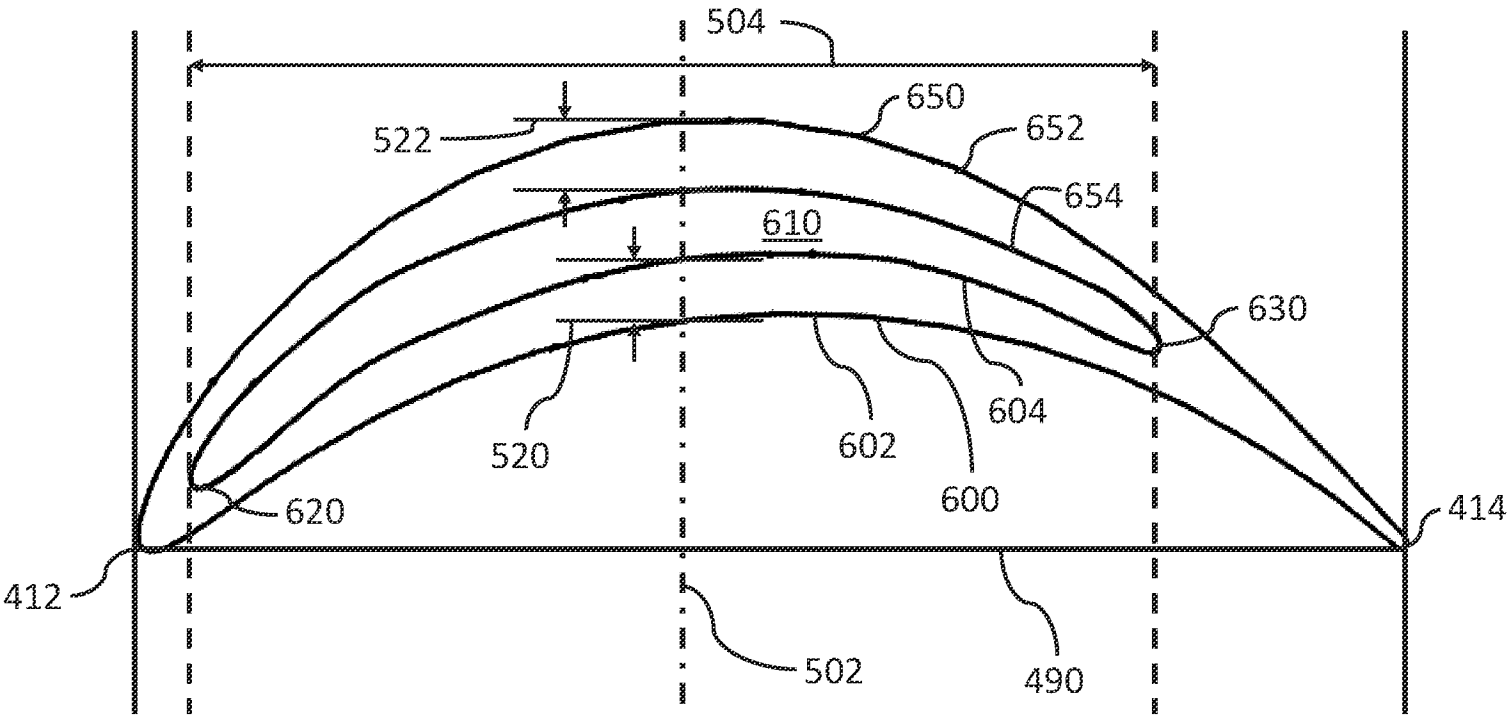
FIG. 7 is a sectional view through a nozzle guide vane according to a first embodiment.

FIG. 7 shows a first sectional view of a known nozzle guide vane 400 according to the present disclosure. As with the nozzle guide vane shown in FIG. 6, the nozzle guide vane 400 of this and the following examples has an aerofoil shape, although the external shape of the nozzle guide vane can vary depending on design requirements and constraints. The external shape can also vary radially between the inner wall 402 and outer wall 404. The thicknesses of the pressure side wall 600 and suction side wall 650 vary in the cavity region 504. In FIG. 7, both the pressure side wall 600 and suction side wall 650 start from a first, relatively narrow wall thickness at the cavity opening point 620, and then gradually increase in thickness up until about 45% of the distance along the chord line, marked by the dash-dot line 502 in FIG. 7. At this point the combined thickness of the pressure side wall 600 and suction side wall 650, i.e. the combined side wall thickness, reaches a maximum value, before both side walls start to decrease in thickness towards the cavity closing point 630. The greater combined side wall thickness in the cavity region allows the nozzle guide vane to absorb a greater amount of energy from any debris impacting upon it, increasing the nozzle guide vane's ability to arrest the movement of, for example, debris from a broken turbine blade. It also decreases the chances of the debris breaking up into smaller pieces which might travel further into the engine.

Figure 8:
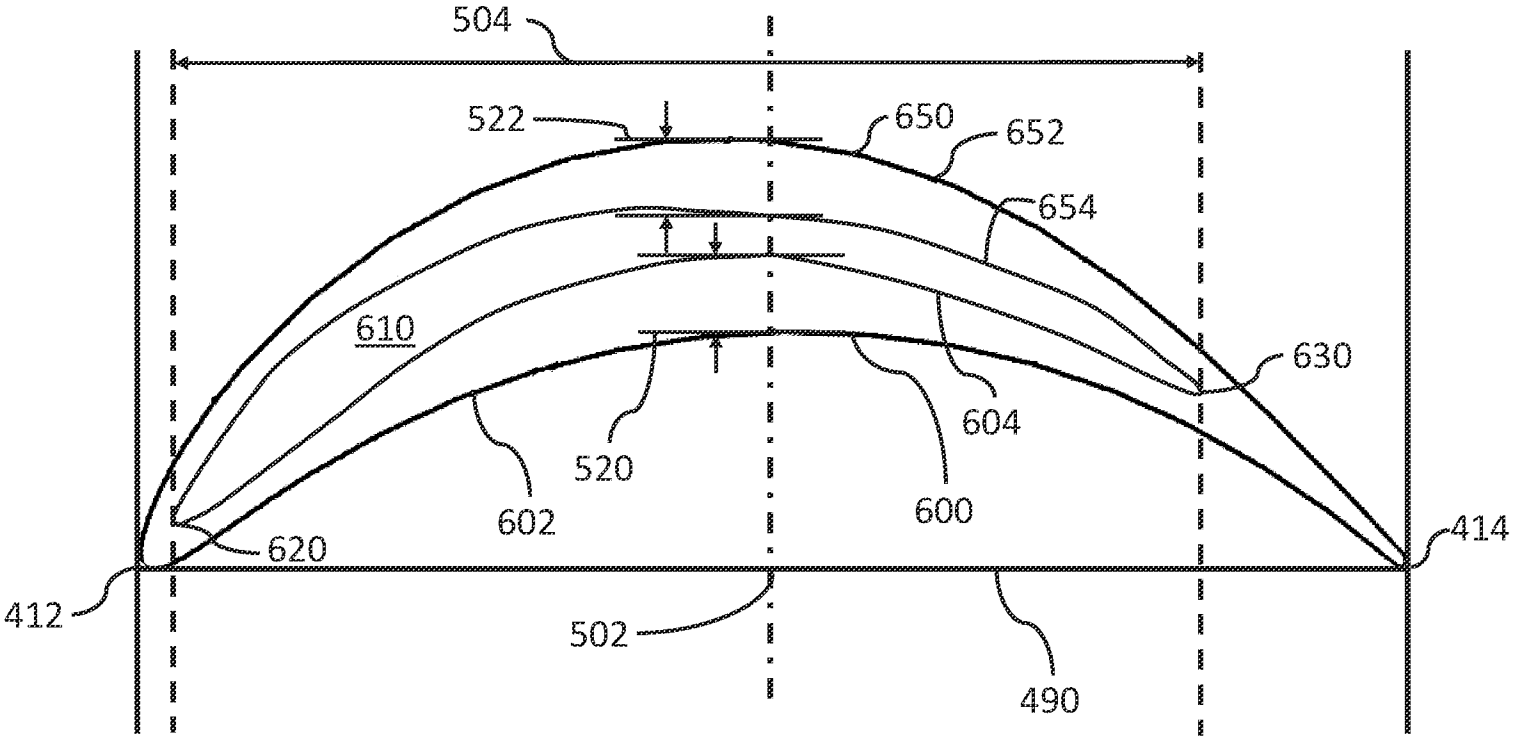
FIG. 8 is a sectional view through a nozzle guide vane according to a second embodiment.
Figure 9:
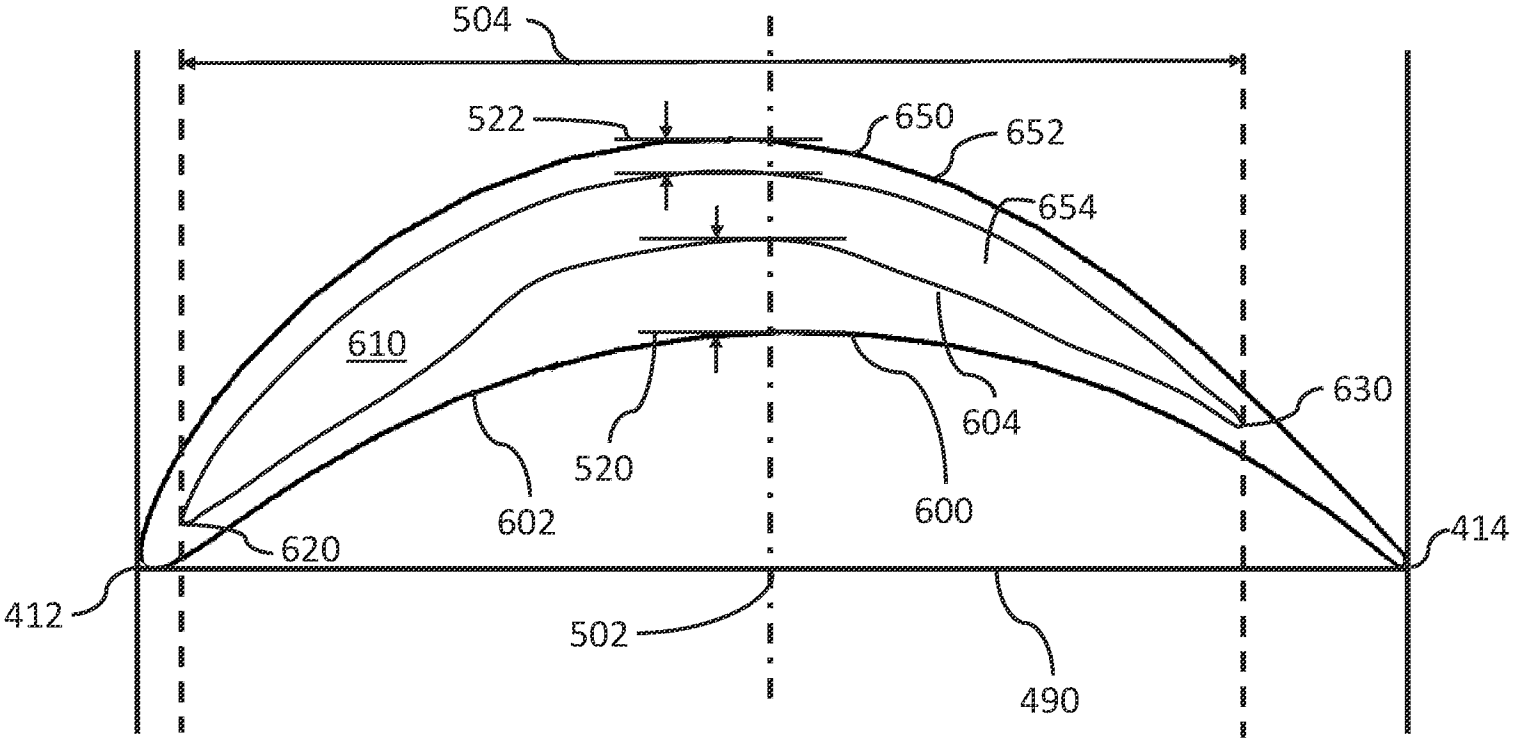
FIG. 9 is a sectional view through a nozzle guide vane according to a third embodiment.
Figure 10:
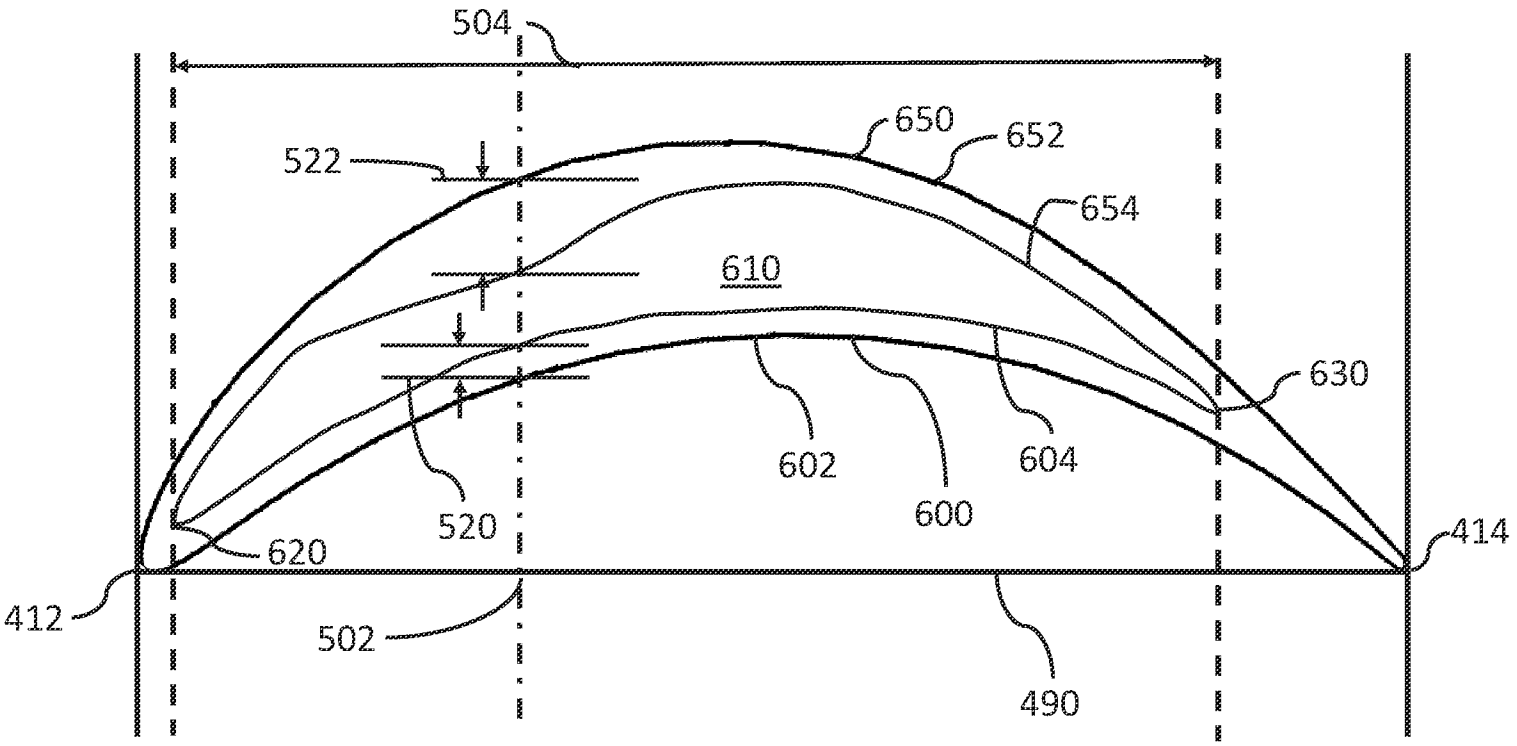
FIG. 10 is a sectional view through a nozzle guide vane according to a fourth embodiment.

FIGS. 8, 9 and 10 show alternative embodiments having the same advantages as that of FIG. 7. Similar features in FIGS. 8, 9 and 10 have been accorded the same number as they have in FIG. 7.

FIG. 8 shows an embodiment similar to that of FIG. 7, except that the point 502 where the combined side wall thickness reaches a maximum value is at about 50% of the length of the chord line 490. It will be appreciated that the point 502 on the chord line where the maximum value of the combined side wall thickness is located can be anywhere along the chord line 490 within the cavity region 504, but we have found the most effective locations to be between 30% and 70% of the chord line, more specifically between 40% and 60% of the chord line, with optimal performance being between 47% and 53% of the chord line, or at around 50% of the chord line.

Figure 11:
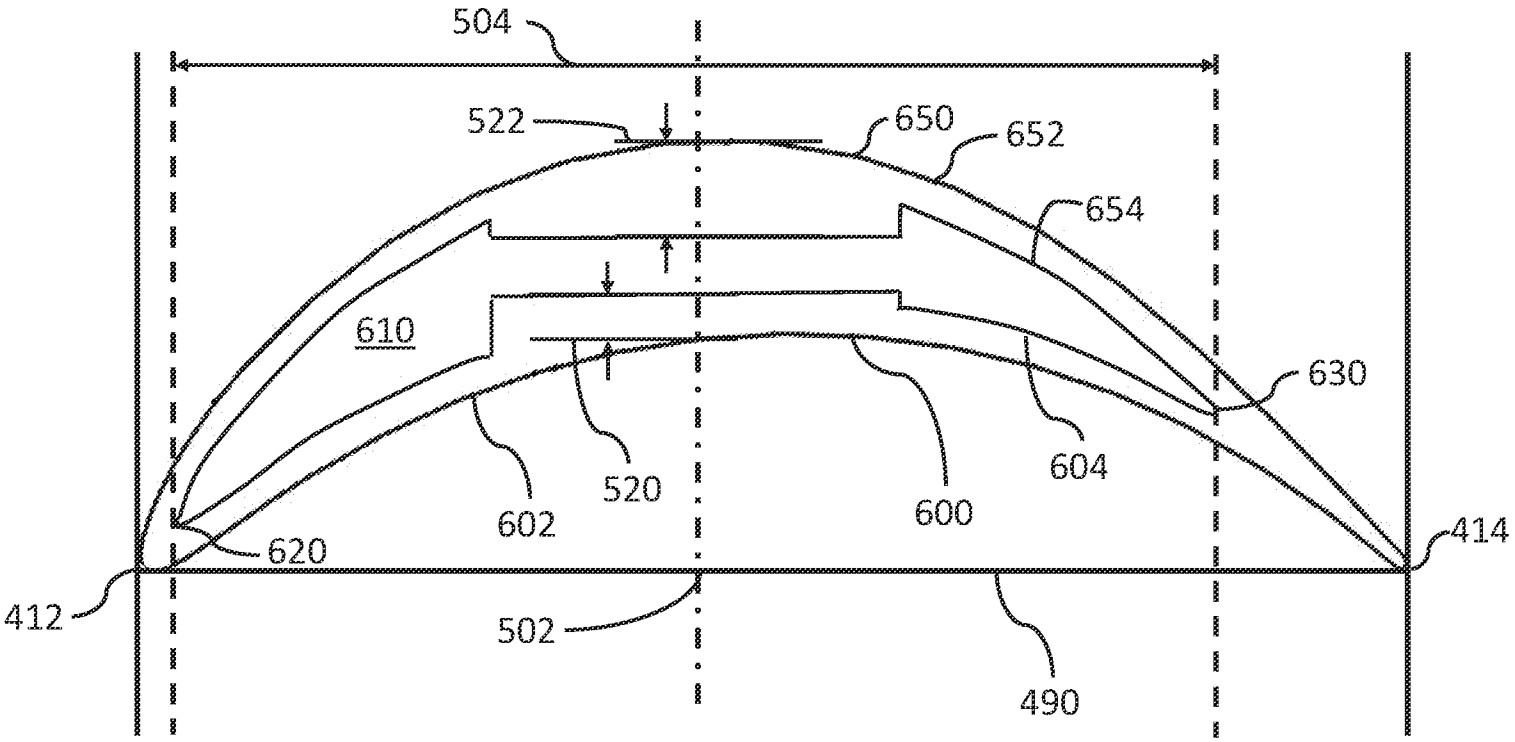
FIG. 11 is a sectional view through a nozzle guide vane according to a fifth embodiment.

It will be apparent to the skilled reader that the thicknesses of the pressure side wall 600 and suction side wall 650 can vary independently, which is to say they do not have to have the same thickness variation profile. FIGS. 9, 10 and 11 show examples of such variations.

FIG. 9 shows an embodiment where the thickness 522 of the suction side wall 650 remains relatively constant throughout the cavity region 504, whereas the thickness 520 of the pressure side wall 600 starts relatively narrowly, then increases along the chord line until reaching a maximum value at a point 502 about 50% of the distance along the chord line between the leading edge and trailing edge, after which the pressure side wall 600 generally decreases in thickness until it reaches the cavity closing point 630. Because the suction side wall 650 remains relatively constant in thickness throughout the cavity region 504, the point on the chord line 510 where the combined side wall thickness is greatest is the point 502 (indicated with the dash-dot line in FIG. 9) where the pressure side wall thickness 520 is at its maximum.

FIG. 10 shows a further alternative embodiment, this time where the thickness 522 of the suction side wall 650 varies, reaching a maximum thickness value at about 30% of the distance along the chord line 490. Because the thickness of the pressure side wall 600 remains relatively constant throughout the cavity region 504, the point on the chord line 490 where the combined side wall thickness is greatest is located at the same point on the chord line, about 30% of the distance along the chord line.

FIG. 11 shows a further alternative embodiment where the thickness of the pressure side wall 600 and suction side wall 650 varies, this time with a step change. In this case, both the pressure side wall and suction side wall undergo a step change increase in thickness at about 30% of the distance along the chord line 490. In this example the first pressure surface 602 and first suction surface 652 maintain their normal exterior profiles, and the second pressure surface 604 and second suction surface 654 run parallel to the chord line after the step change. In this example, the point 502 along the chord line 490 at which the sum of the pressure side wall thickness and suction side wall thickness reaches its maximum is at about 45% of the distance from the leading edge 412 to the trailing edge 414.

Figure 12:
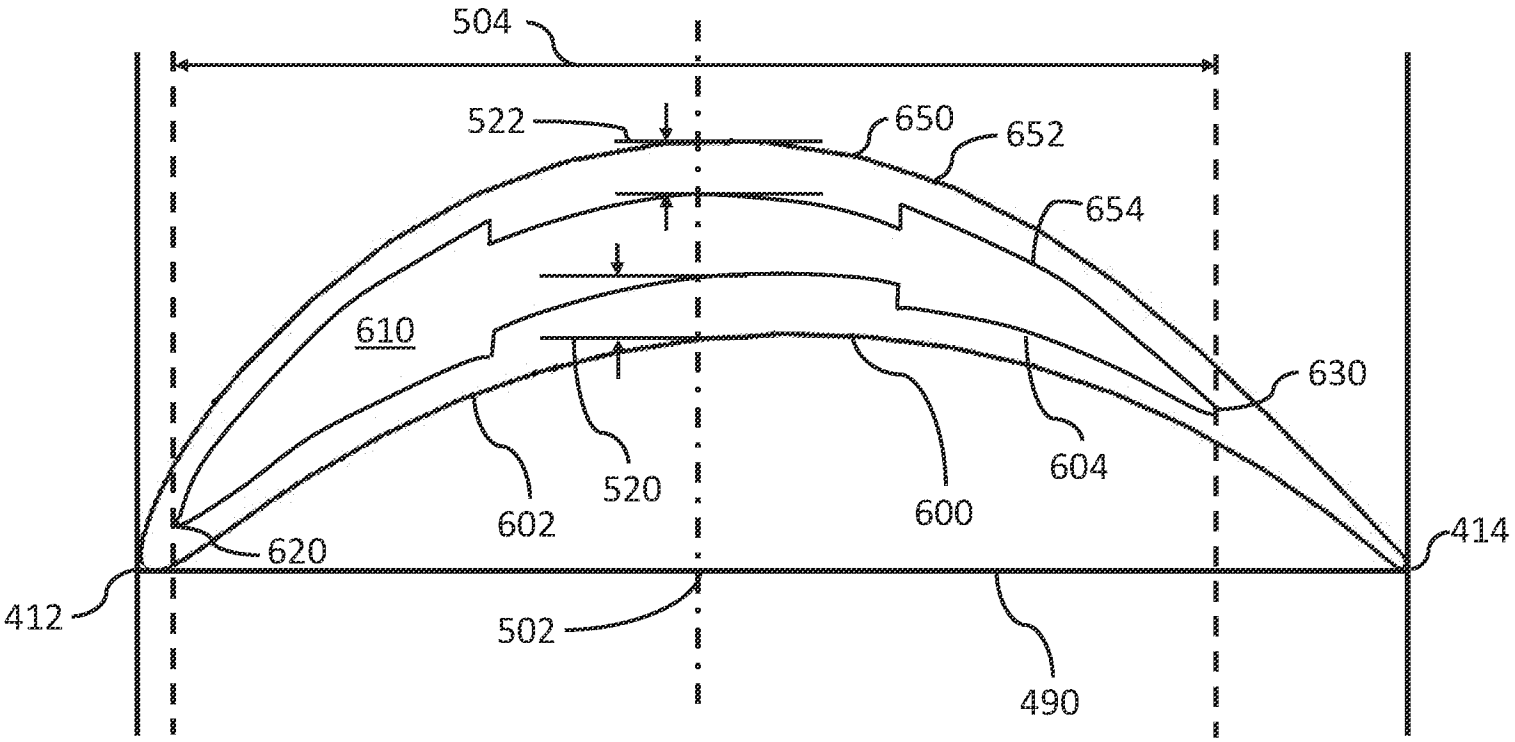
FIG. 12 is a sectional view through a nozzle guide vane according to a sixth embodiment.

FIG. 12 shows a further alternative embodiment where the thickness of the pressure side wall 600 and suction side wall 650 undergoes a step change. Both the pressure side wall and suction side wall undergo a step change increase in thickness at about 30% of the distance along the chord line 490. In this example the first pressure surface 602 and first suction surface 652 maintain their normal exterior profiles, but the second pressure surface 604 and second suction surface 654 run parallel to the first pressure surface 602 and first suction surface 652 respectively at a greater distance from after the step change, so as to create a region of increased thickness. In this example, there is no one point along the chord line 490 at which the sum of the pressure side wall thickness and suction side wall is thicker than any other point. Instead, a range of points are equal to the maximum thickness value. In this example those points are between about 30% and 60% of the chord line. In such a case, all points having a combined side wall thickness value equal to the maximum value of the combined side wall thickness would be considered as a point having the maximum value of the combined side wall thickness.

It will be understood from the examples of FIGS. 7 to 12 that there are many ways in which the thickness of the pressure side wall 600 and suction side wall 650 can be varied in order to gain the benefit of the present disclosure.

Figure 13:
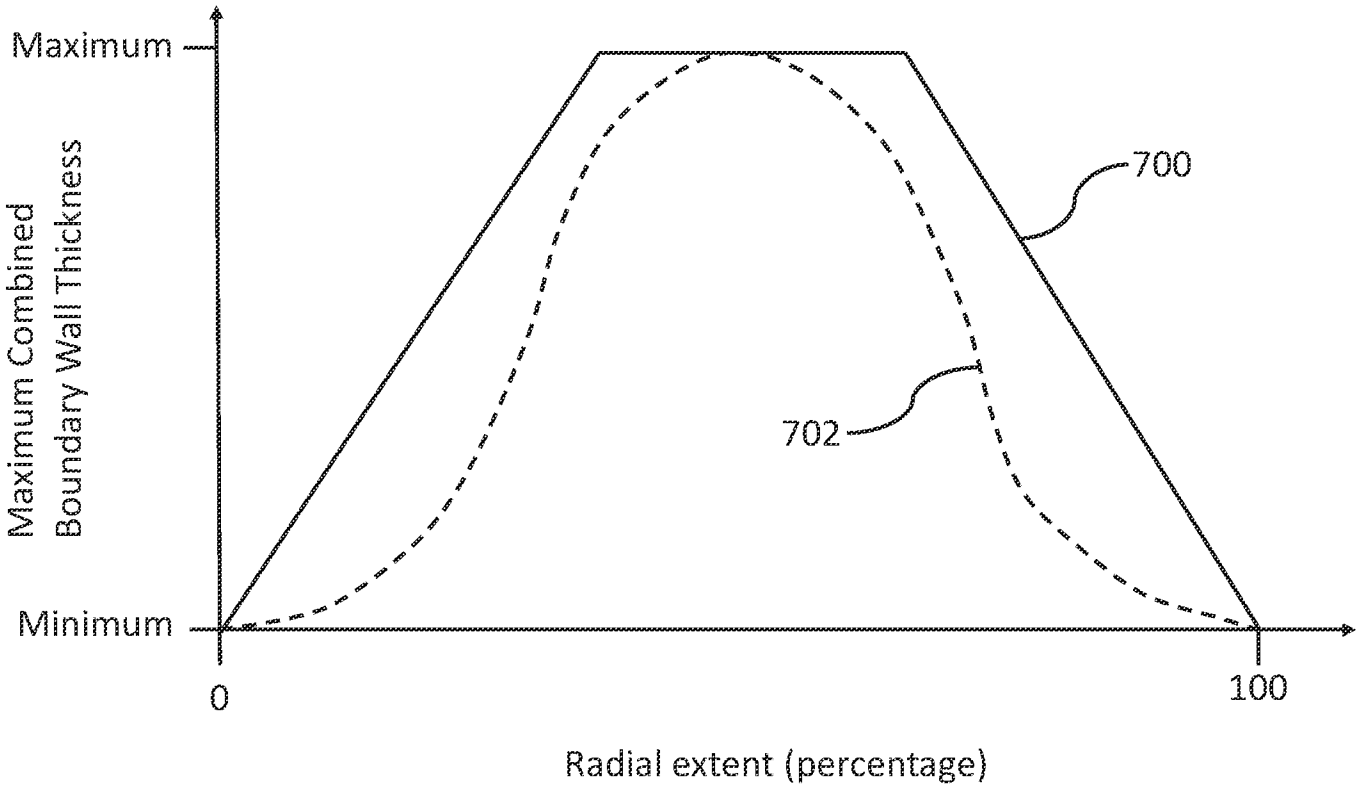
FIG. 13 is a first plot showing variation between planes of constant radial extent of the maximum value of the combined side wall thickness according to alternative embodiments.

Referring back to FIG. 5 and the line of increasing radial extent 420, FIG. 13 illustrates a first 700 and second 702 example of how the maximum value of the combined side wall thickness can vary between planes of constant radial extent 450, 460 along the radial extent of the nozzle guide vane. In the first example 700, illustrated by the solid line, the maximum value of the side wall thickness starts off at a minimum value at the radially inner boundary. This might, for example, be equivalent to the nozzle guide vane 400 having a sectional topography where the pressure 600 and suction 650 side walls are of constant thickness, as shown in FIG. 6, with neither side wall having a thickened section. As the radial extent of the nozzle guide vane increases, the maximum value of the combined side wall thickness increases, reaching a maximum value for the nozzle guide vane at a plane located at around 35% of the radial extent of the nozzle guide vane. This could be achieved by both the pressure 600 and suction 650 side walls increasing in thickness between planes, or by just one or the other of the pressure 600 and suction 650 side walls increasing in thickness between planes. The nozzle guide vane maintains this maximum value of combined side wall thickness up until about 70% of the radial extent of the nozzle guide vane, before reducing back to its starting value as the nozzle guide vane 400 reaches its maximum extent at the radially outer boundary 410 with the outer wall 404. This could be achieved by both the pressure 600 and suction 650 side walls decreasing in thickness, or by one of the other of the pressure 600 and suction 650 side walls decreasing in thickness. Alternatively, as shown by the dashed line 702, the variation in the maximum combined thickness can be non-linear. In this second example, the maximum combined side wall thickness again starts off at a minimum value at the radially inner boundary. The maximum combined side wall thickness then increases, slowly at first, then more rapidly, then slowly again, until it reaches a maximum at a plane located at about 50% of the radial extent of the nozzle guide vane. As with the first example 700, this could be achieved by both the pressure 600 and suction 650 side walls increasing in thickness between planes so as to achieve profiles like those as shown in FIG. 8, 11 or 12, or by one of the other of the pressure 600 and suction 650 side walls increasing in thickness between planes so as to achieve profiles like those as shown in FIGS. 9 and 10. After passing the 50% radial extent, the maximum combined side wall thickness starts to decrease, slowly at first, then more rapidly, then slowly again, until reaching the minimum value at the maximum radial extent. In this way the profile of the maximum combined side wall thickness varies almost pseudo-sinusoidally with radial extent. These first two examples are advantageous if the most likely region for debris to impact the nozzle guide vane is around the middle of the radial extent, as it minimises the amount of extra material, and therefore extra mass, needing to be added to the nozzle guide vane in order to allow it to absorb the energy expended upon it by any incoming debris.

Figure 14:
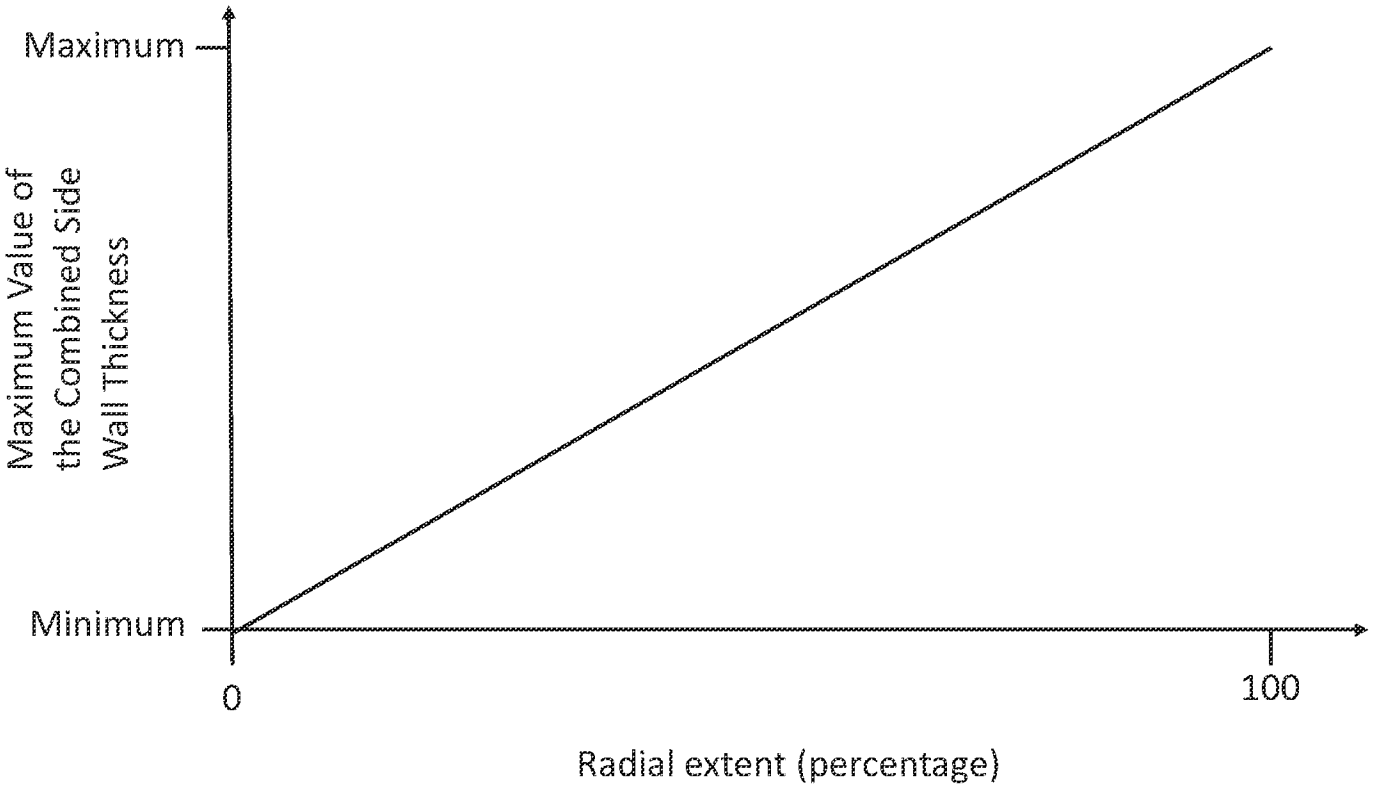
FIG. 14 is a second plot showing variation between planes of constant radial extent of the maximum value of the combined side wall thickness according to a further alternative embodiment.

FIG. 14 illustrates a third example of how the maximum value of the combined side wall thickness can vary between planes of constant radial extent 450, 460 along the radial extent of the nozzle guide vane. In this third example, the maximum combined side wall thickness starts off at a minimum value at the radially inner boundary, and then increases linearly until the nozzle guide vane 400 reaches its maximum extent at the radially outer boundary 410 with the outer wall 404. As with FIG. 13, this could be achieved by both the pressure 600 and suction 650 side walls increasing in thickness between planes so as to achieve profiles like those as shown in FIG. 8, 11 or 12, or by one of the other of the pressure 600 and suction 650 side walls increasing in thickness between planes so as to achieve profiles like those as shown in FIGS. 9 and 10. In this example therefore the part of the nozzle guide vane where the maximum combined side wall thickness has its greatest value is at the nozzle guide vane's greatest radial extent. This arrangement is advantageous if the likelihood of debris impacting the nozzle guide vane increases with radial extent.

Figure 15:
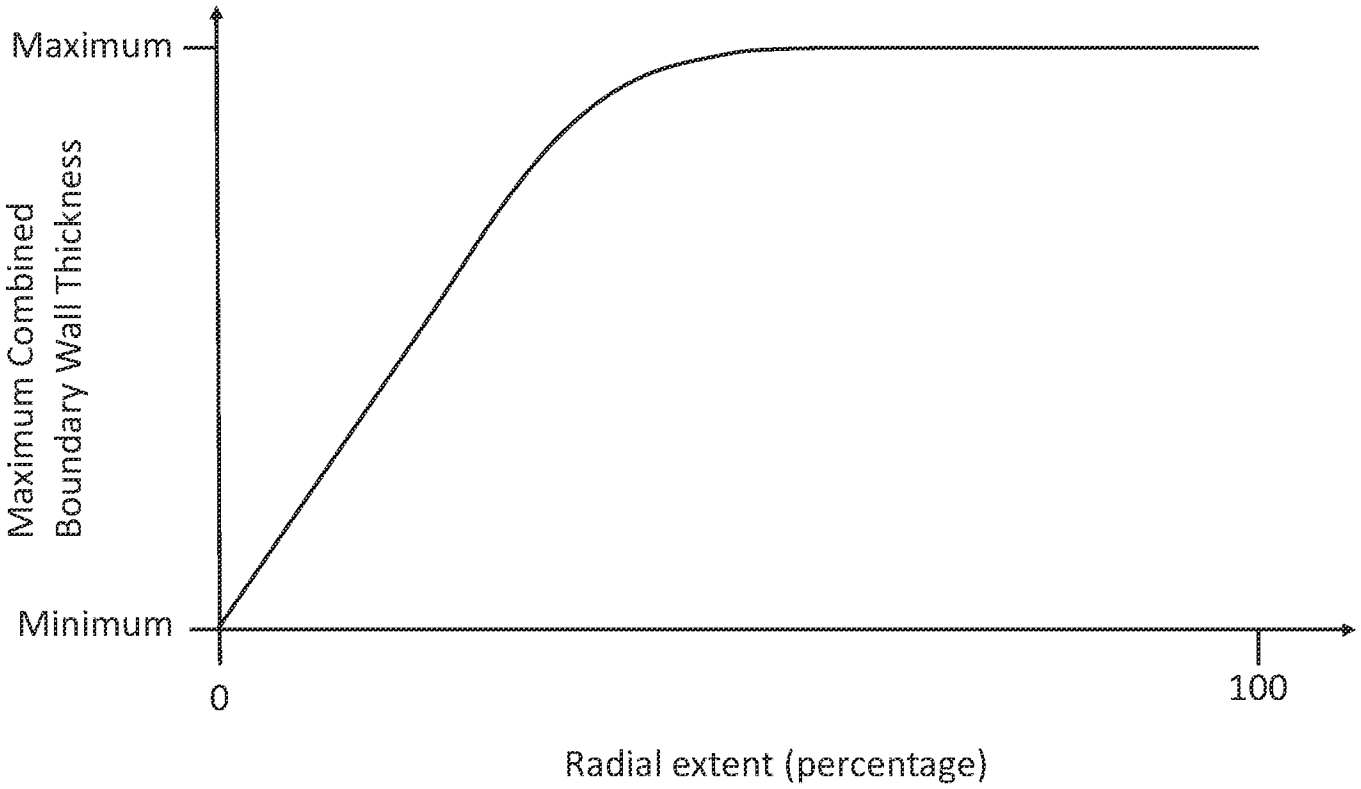
FIG. 15 is a third plot showing variation between planes of constant radial extent of the maximum value of the combined side wall thickness according to a further alternative embodiment.

FIG. 15 illustrates a fourth example of how the maximum value of the combined side wall thickness can vary between planes of constant radial extent 450, 460 along the radial extent of the nozzle guide vane. In this fourth example, the maximum combined side wall thickness starts off at a minimum value at the radially inner boundary, and then increases linearly until around 35% of the radial extent of the nozzle guide vane, where it levels off as it reaches its maximum value of maximum combined side wall thickness at around 50% of the radial extent. As with FIGS. 13 and 14, this could be achieved by both the pressure 600 and suction 650 side walls increasing in thickness between planes so as to achieve profiles like those as shown in FIG. 8, 11 or 12, or by one or the other of the pressure 600 and suction 650 side walls increasing in thickness between planes so as to achieve profiles like those as shown in FIGS. 9 and 10. The nozzle guide vane 400 then maintains this maximum value of maximum combined side wall thickness until it reaches its maximum extent at the radially outer boundary 410 with the outer wall 404. Nozzle guide vanes with variations of the maximum combined side wall thickness like this are advantageous if it is unlikely that debris will impact the nozzle guide vane around its inner radial extent, as it provides an optimal balance between the amount of extra mass and material required to strengthen the nozzle guide vane and the amount of mass the nozzle guide vane adds to the engine versus a traditional nozzle guide vane.

It will be appreciated that the thickness variations illustrated in FIGS. 13 to 15 are merely exemplary of the various combined side wall thickness distributions that could be envisaged by the skilled person, depending on the structure of the engine and the calculated or measured probability distribution of debris impact locations on the nozzle guide vane. For example, the changes with radial extent of the maximum combined side wall thickness may take on a non-linear profile, for example according to a non-linear equation, or it may just follow a profile based on empirical measurements rather than a mathematical equation.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

We claim:

1. A nozzle guide vane for a gas turbine engine, the nozzle guide vane comprising:

a pressure side wall having a first pressure surface on the exterior of the nozzle guide vane and a second pressure surface on the interior of the nozzle guide vane;

a suction side wall having a first suction surface on the exterior of the nozzle guide vane and a second suction surface on the interior of the nozzle guide vane;

a radially inner boundary;

a radially outer boundary;

a leading edge; and a trailing edge; wherein the pressure side wall and suction side wall extend from the radially inner boundary to the radially outer boundary and from the leading edge to the trailing edge;

the nozzle guide vane further comprising a cavity region where the second pressure surface and the second suction surface are spaced apart so as to create a cavity between them, the cavity having a cavity opening point which is nearest to the leading edge of the nozzle guide vane, and a cavity closing point which is nearest to the trailing edge of the nozzle guide vane;

the nozzle guide vane has a chord line which is a straight line connecting the leading edge to the trailing edge;

in each plane of constant radial extent between the radially inner boundary and radially outer boundary:

a pressure side wall thickness value for any point on the chord line is defined as the distance between the first pressure surface and the second pressure surface measured perpendicular to the chord line at that point on the chord line, and a suction side wall thickness value for any point on the chord line is defined as the distance between the first suction surface and the second suction surface measured perpendicular to the chord line at that point on the chord line;

the sum of the pressure side wall thickness value and the suction side wall thickness value for a given point of the chord line between the cavity opening point and the cavity closing point is defined as the combined side wall thickness;

the combined side wall thickness varies along the chord line between the cavity opening point and the cavity closing point, such that the maximum value of the combined side wall thickness is at a point on the chord line between 30% and 70% of the chord line; and the maximum value of the combined side wall thickness is maximum in a region between 35% and 70% of the radial extent of the nozzle guide vane and decreases progressively away from the maximum toward the radially inner boundary and radially outer boundary.

2. The nozzle guide vane of claim 1, wherein the maximum value of the combined side wall thickness is at a point on the chord line between 40% and 60% of the chord line.

3. The nozzle guide vane of claim 1, wherein the maximum value of the combined side wall thickness is at a point on the chord line between 47% and 53% of the chord line.

4. The nozzle guide vane of claim 1, the nozzle guide vane comprising a leading edge region wherein the pressure side wall and suction side wall are joined from the leading edge to the cavity opening point and the leading edge region extends up to 10% of the length of the chord line from the leading edge.

5. The nozzle guide vane of claim 4, wherein the leading edge region extends up to 6% of the length of the chord line from the leading edge.

6. The nozzle guide vane of claim 1, the nozzle guide vane comprising a trailing edge region wherein the pressure side wall and suction side wall are joined between the cavity closing point and the trailing edge, and the trailing edge region extends from up to 10% to up to 30% of the length of the chord line from the trailing edge.

7. The nozzle guide vane of claim 6, wherein the trailing edge region extends from up to 18% to up to 22% of the length of the chord line from the trailing edge.

8. The nozzle guide vane of claim 1, wherein the minimum value of the combined side wall thickness is at a point on the chord line between the cavity opening point and the cavity closing point where the combined side wall thickness has a minimum value; and the ratio between the maximum and minimum combined side wall thicknesses is between 1.6:1 and 3:1.

9. The nozzle guide vane of claim 8, wherein the ratio between the maximum and minimum combined side wall thicknesses is between 2:1 and 2.5:1.

10. The nozzle guide vane of claim 1, wherein only one of the pressure side wall or the suction side wall varies in thickness between the cavity opening point and the cavity closing point.

11. The nozzle guide vane of claim 1, wherein both the pressure side wall and the suction side wall vary in thickness between the cavity opening point and the cavity closing point.

12. The nozzle guide vane of claim 1, wherein the maximum value of the combined side wall thickness is minimum at the plane of minimum radial extent of the nozzle guide vane.

13. The nozzle guide vane of claim 1, wherein the maximum value of the combined side wall thickness reaches a maximum value at a plane between 40% and 60% of the maximum radial extent of the nozzle guide vane.

14. A gas turbine engine for an aircraft, the gas turbine engine comprising a nozzle guide vane according to claim 1.

15. The nozzle guide vane of claim 1, wherein the maximum value of the combined side wall thickness is at a point on the chord line between 40% and 60% of the chord line, and the maximum value of the combined side wall thickness is minimum at the plane of minimum radial extent of the nozzle guide vane.

16. A nozzle guide vane for a gas turbine engine, the nozzle guide vane comprising:

a pressure side wall having a first pressure surface on the exterior of the nozzle guide vane and a second pressure surface on the interior of the nozzle guide vane;

a suction side wall having a first suction surface on the exterior of the nozzle guide vane and a second suction surface on the interior of the nozzle guide vane;

a radially inner boundary;

a radially outer boundary;

a leading edge; and a trailing edge; wherein the pressure side wall and suction side wall extend from the radially inner boundary to the radially outer boundary and from the leading edge to the trailing edge;

the nozzle guide vane further comprising a cavity region where the second pressure surface and the second suction surface are spaced apart so as to create a cavity between them, the cavity having a cavity opening point which is nearest to the leading edge of the nozzle guide vane, and a cavity closing point which is nearest to the trailing edge of the nozzle guide vane;

the nozzle guide vane has a chord line which is a straight line connecting the leading edge to the trailing edge;

in each plane of constant radial extent between the radially inner boundary and radially outer boundary:

a pressure side wall thickness value for any point on the chord line is defined as the distance between the first pressure surface and the second pressure surface measured perpendicular to the chord line at that point on the chord line, and a suction side wall thickness value for any point on the chord line is defined as the distance between the first suction surface and the second suction surface measured perpendicular to the chord line at that point on the chord line;

the sum of the pressure side wall thickness value and the suction side wall thickness value for a given point of the chord line between the cavity opening point and the cavity closing point is defined as the combined side wall thickness;

the combined side wall thickness varies along the chord line between the cavity opening point and the cavity closing point, such that the maximum value of the combined side wall thickness is at a point on the chord line between 30% and 70% of the chord line; and the maximum value of the combined side wall thickness is minimum at the plane of minimum radial extent of the nozzle guide vane, then the maximum value of the combined side wall thickness increases linearly, and the maximum value of the combined side wall thickness is maximum beginning at a plane between 40% and 60% of the maximum radial extent of the nozzle guide vane through the plane of maximum radial extent of the nozzle guide vane.

17. A nozzle guide vane for a gas turbine engine, the nozzle guide vane comprising:

a pressure side wall having a first pressure surface on the exterior of the nozzle guide vane and a second pressure surface on the interior of the nozzle guide vane;

a suction side wall having a first suction surface on the exterior of the nozzle guide vane and a second suction surface on the interior of the nozzle guide vane;

a radially inner boundary;

a radially outer boundary;

a leading edge; and a trailing edge; wherein the pressure side wall and suction side wall extend from the radially inner boundary to the radially outer boundary and from the leading edge to the trailing edge;

the nozzle guide vane further comprising a cavity region where the second pressure surface and the second suction surface are spaced apart so as to create a cavity between them, the cavity having a cavity opening point which is nearest to the leading edge of the nozzle guide vane, and a cavity closing point which is nearest to the trailing edge of the nozzle guide vane;

the nozzle guide vane has a chord line which is a straight line connecting the leading edge to the trailing edge;

in each plane of constant radial extent between the radially inner boundary and radially outer boundary:

a pressure side wall thickness value for any point on the chord line is defined as the distance between the first pressure surface and the second pressure surface measured perpendicular to the chord line at that point on the chord line, and a suction side wall thickness value for any point on the chord line is defined as the distance between the first suction surface and the second suction surface measured perpendicular to the chord line at that point on the chord line;

the sum of the pressure side wall thickness value and the suction side wall thickness value for a given point of the chord line between the cavity opening point and the cavity closing point is defined as the combined side wall thickness;

the combined side wall thickness varies along the chord line between the cavity opening point and the cavity closing point, such that the maximum value of the combined side wall thickness is at a point on the chord line between 30% and 70% of the chord line; and the maximum value of the combined side wall thickness has a minimum value at the plane of minimum radial extent of the nozzle guide vane and increases linearly to a maximum value at the plane of maximum radial extent of the nozzle guide vane.

* * * * *